US006802082B2

(12) United States Patent
Watley

(10) Patent No.: US 6,802,082 B2
(45) Date of Patent: Oct. 12, 2004

(54) INSECT-PROOF CAMOUFLAGED MATERIAL AND GARMENT MADE THEREFROM

(75) Inventor: Bruce E. Watley, Centerville, IA (US)

(73) Assignee: Bug-Out Outdoor Wear, Centervlle, IA (US)

( * ) Notice: Subject to any disclaimer, the term of this patent is extended or adjusted under 35 U.S.C. 154(b) by 277 days.

(21) Appl. No.: 10/166,995

(22) Filed: Jun. 11, 2002

(65) Prior Publication Data

US 2003/0226195 A1 Dec. 11, 2003

(51) Int. Cl.[7] ..... A41D 1/02; A41D 13/00; F41H 3/00

(52) U.S. Cl. ..... 2/94; 2/900; 428/17; 428/919

(58) Field of Search ..... 2/69, 4, 93, 94, 2/84, 108, 202, 900; 428/17, 18, 24, 919

(56) References Cited

U.S. PATENT DOCUMENTS 4,560,595 A * 12/1985 Johansson ..... 428/17
4,716,594 A 1/1988 Shannon
5,486,385 A 1/1996 Bylund et al.
5,695,835 A 12/1997 Weber et al.
6,127,007 A * 10/2000 Cox et al. ..... 428/15
D436,715 S 1/2001 Barnhart
6,499,141 B1 * 12/2002 Egnew ..... 2/69

* cited by examiner

*Primary Examiner*—Peter Nerbun

(57) ABSTRACT

A camouflaged material for outdoor wear has an inside liner material with a fine mesh to prevent the passage of insects therethrough. An outside layer overlays the inside layer and is die-cut to have a plurality of leaf tabs cut therein with the leaf tabs having a substantially elliptical shape having a cut perimeter on opposite sides and a cut end therebetween, with an opposite end to the cut end forming a live hinge with respect to the outside layer, to permit the leaf tabs to deflect from the outside layer in a random fashion to create an outer appearance of random leaves.

21 Claims, 5 Drawing Sheets

INSECT-PROOF CAMOUFLAGED MATERIAL AND GARMENT MADE THEREFROM

BACKGROUND OF THE INVENTION

Certain garments made for wearing in the out-of-doors while hunting require both resistance to insects and a camouflaged appearance. See for example, U.S. Pat. Nos. 5,695,835 and 5,486,385. However, the existing material and the garments made from the material are expensive to manufacture and are sometimes lacking in resisting infiltration by all insects, or in creating an effective camouflage appearance.

It is therefore a principal object of this invention to provide an improved insect proof camouflaged material and garments made therefrom.

A further object of this invention is to provide a camouflaged material that is also highly resistive to insect penetration, and vice versa.

A still further object of this invention is to provide an insect-proof camouflaged material and garment made therefrom which is economic of manufacture.

These and other objects will be apparent to those skilled in the art.

SUMMARY OF THE INVENTION

A camouflaged material for outdoor wear has an inside liner material with a fine mesh to prevent the passage of insects therethrough. An outside layer overlays the inside layer and is die-cut to have a plurality of leaf tabs cut therein with the leaf tabs having a substantially elliptical shape having a cut perimeter on opposite sides and a cut end therebetween, with an opposite end to the cut end forming a live hinge with respect to the outside layer, to permit the leaf tabs to deflect from the outside layer in a random fashion to create an outer appearance of random leaves on a growing plant.

The leaf tabs are arranged in rows and are arranged in alternate pairs in each row wherein the live hinges on two adjacent leaves are juxta-positioned with each other with the uncut ends of each pair of leaf tabs being juxta-positioned with the uncut ends of adjacent leaf tabs to form a continuous row of repeated pairs of such leaf tabs.

DESCRITPION OF THE PREFERRED EMBODIMENT

Figure 8:
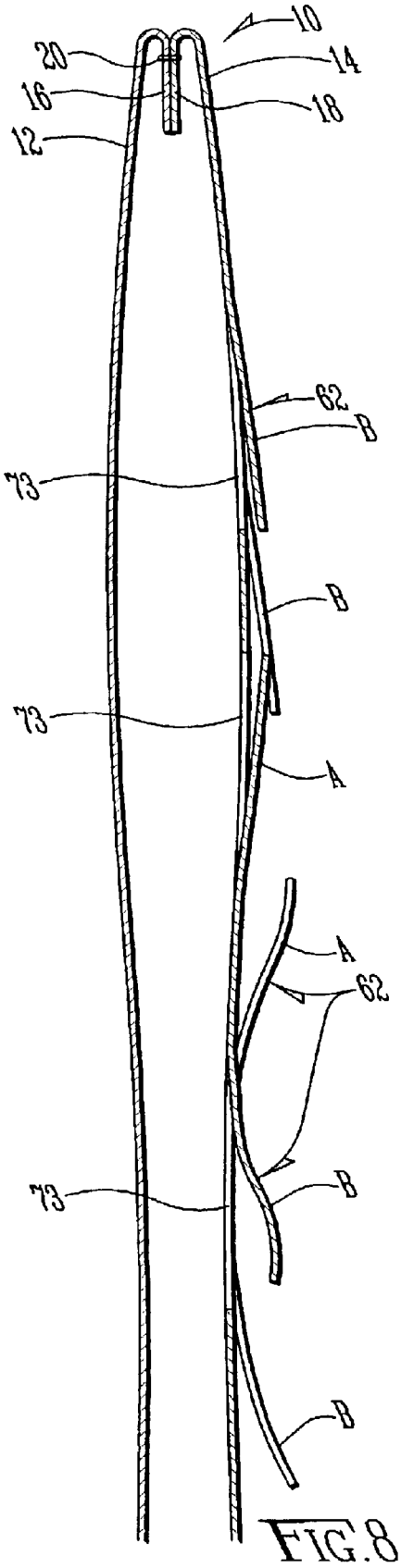
FIG. 8 is an enlarged scale sectional view through the material of this invention showing both the inner and outer layers and the leaf tabs.

With reference to FIG. 8, the material 10 of this invention is comprised generally of an inner layer 12 and an outer layer 14. The numerals 16 and 18 in FIG. 8 designate the perimeter edges of layers 12 and 14 respectively. Stitches 20 are used to secure the perimeter edges 16 and 18 together.

The inner layer is comprised of a woven mesh material having apertures of $1/32^{nd}$ of an inch to resist the penetration of insects therethrough. The outer layer 14 is comprised of a camouflaged decor varying in colors and arrays of colors to blend in with the natural foliage of the outdoors. The inner layer can be of a similar decor and at least should be of a color not significantly different than the outer layer.

Figure 1:
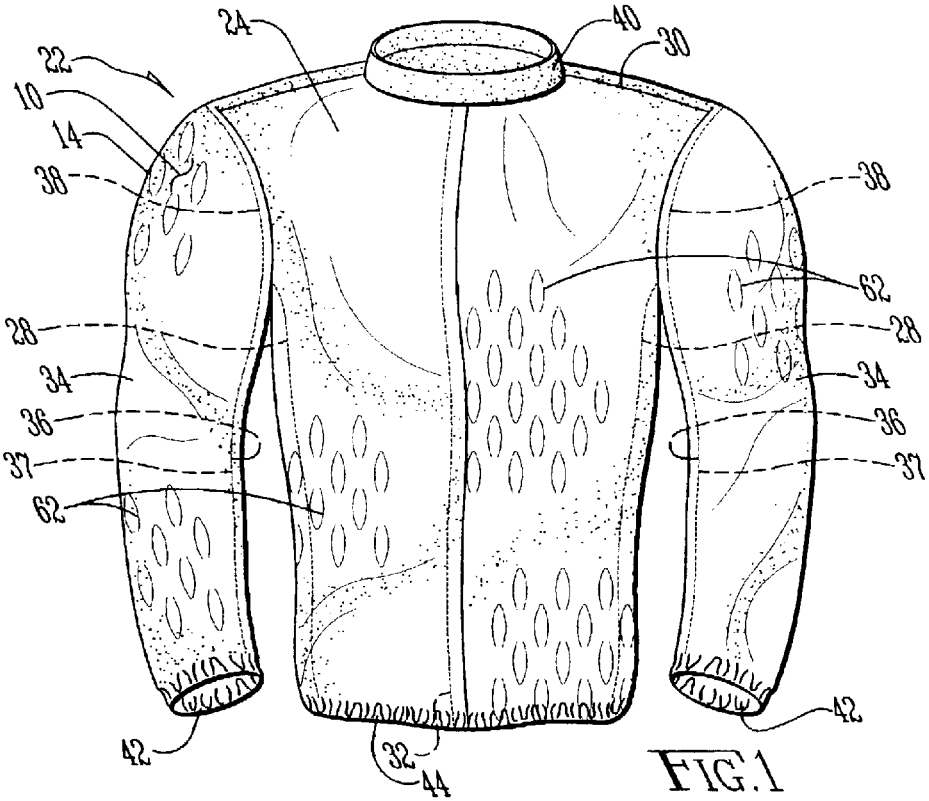
FIG. 1 is a front elevation of an upper garment made from the material of this invention.
Figure 2:
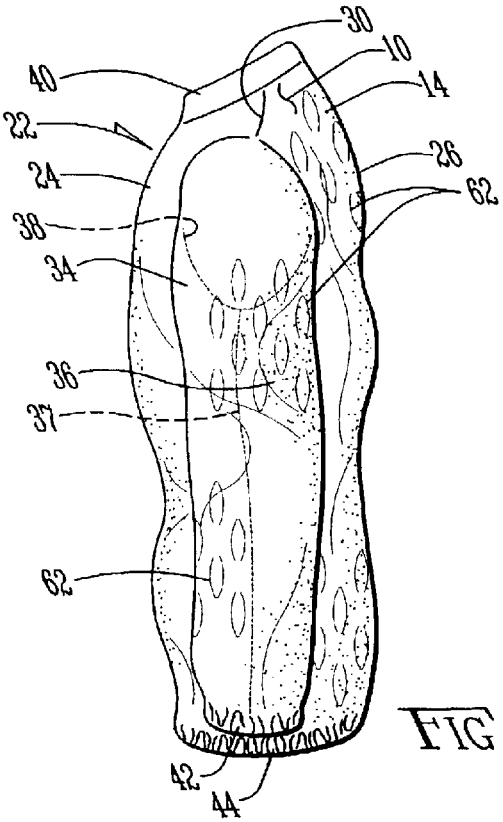
FIG. 2 is a side elevational view thereof as seen from the right-hand side of FIG. 1.
Figure 3:
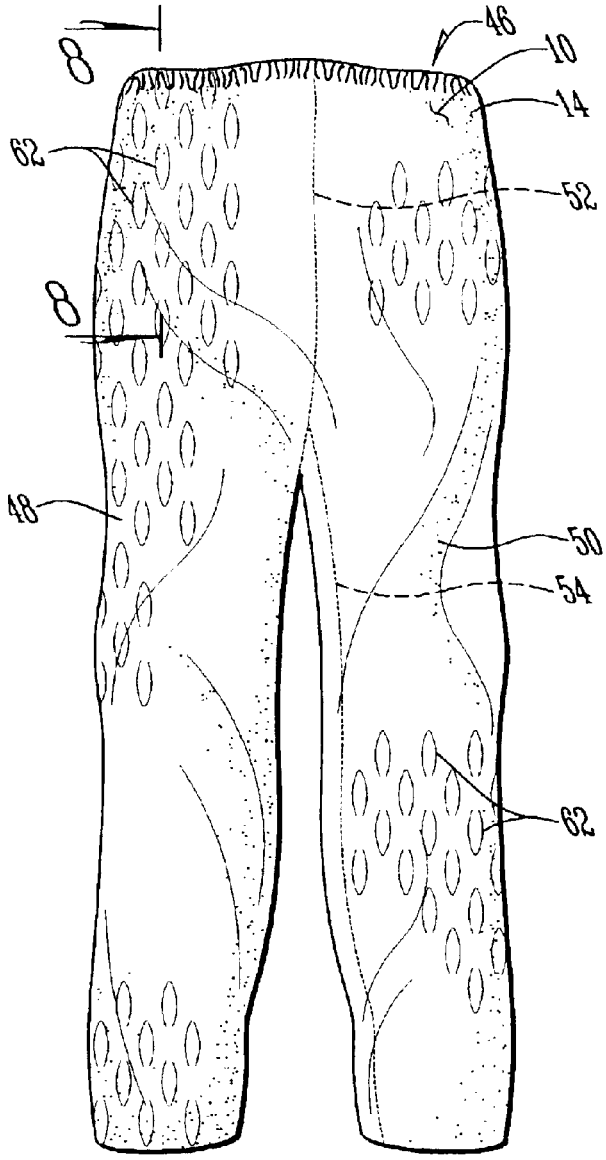
FIG. 3 is a front elevation of a lower garment made from the material of this invention.

With reference to FIG. 1, an upper garment 22 is comprised of breast panels 24 and back and shoulder panel 26 which are sewn together at their respective adjacent perimeters or seams 28 and 30. A zipper 32 or the like can be used to join the breast panels 24. Arm panels 34 and 36 have perimeter seams 37 and 38 and are secured to the panels 24 and 26 at perimeter seams 37 and 38. The neck portion 40 is formed at the upper portion of the upper garment 22 as best shown in FIGS. 1 and 2. Elastic cuffs 42 can be formed at the lower end of the arm panels 34 and 36 and at the lower edge 44 of the upper garment 22, again as best shown in FIGS. 1 and 2. With reference to FIG. 3, trousers made out of the material 10 have leg panels 48 and 50 which are stitched together only at their perimeter seams 52 and 54.

Figure 4:
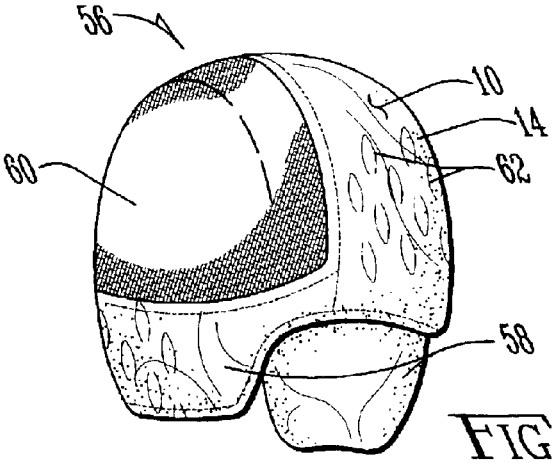
FIG. 4 is a perspective view of a hood to be worn with the garments of this invention.

A hood 56 is shown in FIG. 4 and includes a flap 58 and a vision panel 60 comprised essentially of the material of the inner layer or with a layer of material having a slightly larger woven mesh with openings greater than $1/32^{nd}$ of an inch.

Figure 7:
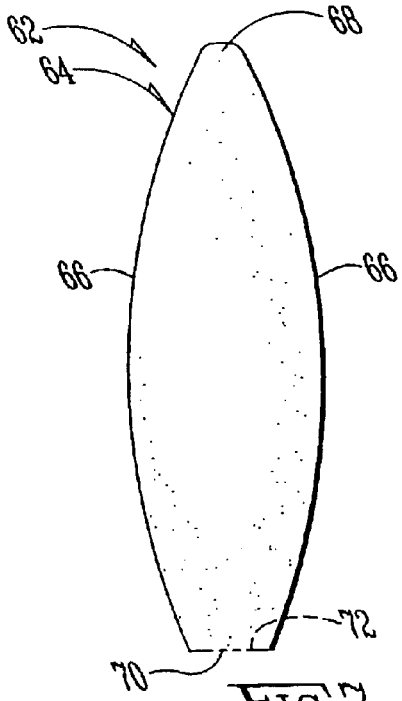
FIG. 7 is an enlarged scale plan view of a leaf tab of the material of this invention.

A plurality of leaf tabs 62 elliptical in shape and having a cut perimeter 64 is best shown in FIG. 7. The leaf tabs are die-cut into the outer layer before the inner and outer layer are secured together. The leaf tabs have opposite sides 66, and a cut end 68 therebetween and an uncut end 70 comprising a live hinge 72 so that the leaf tabs can be folded with respect to the plane of the outer layer. An opening 73 having the identical configuration of the leaf tab 62 appears immediately adjacent each leaf tab as best shown in FIG. 8.

Figure 5:
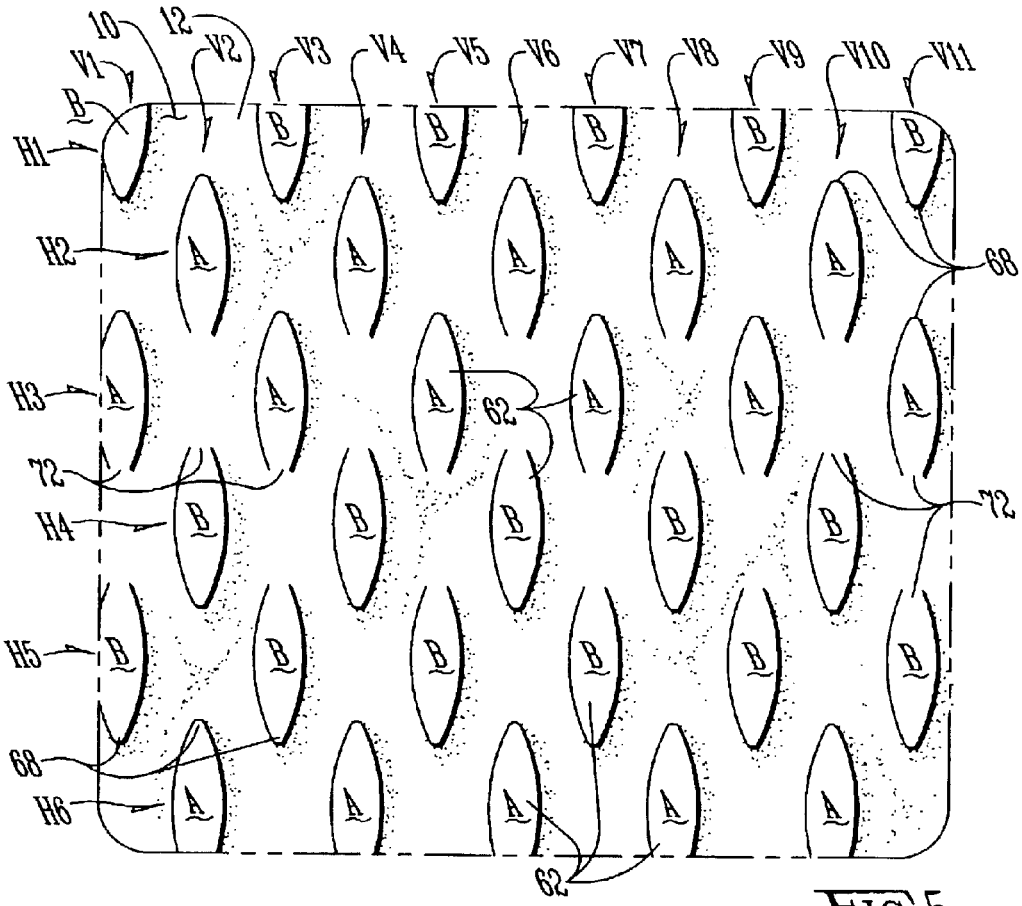
FIG. 5 is an enlarged scale plan view of the outer layer of material.
Figure 6:
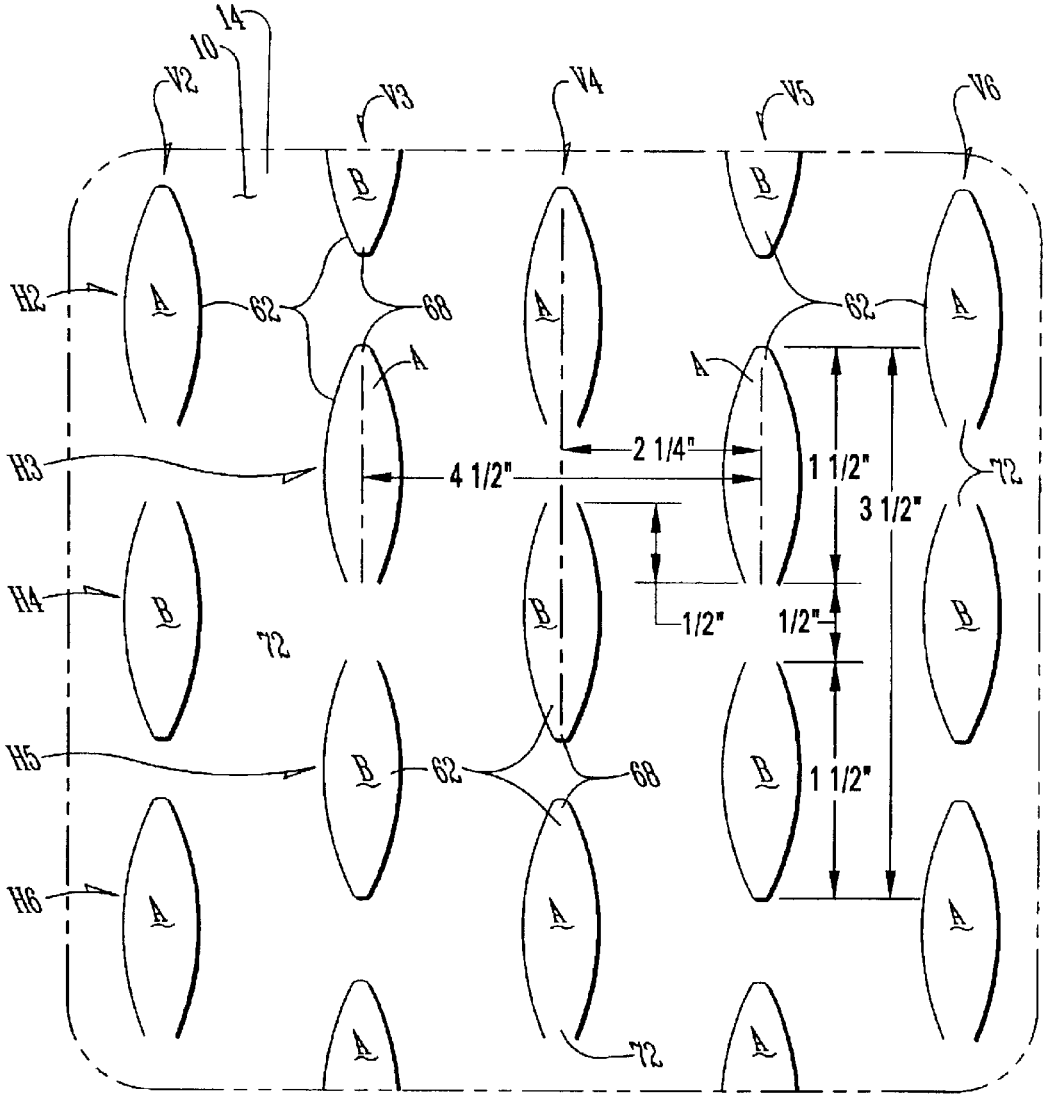
FIG. 6 is an enlarged view of FIG. 5 showing preferred dimensional data.

With reference to FIGS. 5 and 6, the outer layer includes horizontal rows of leaf tabs H1–H6, and vertical rows of leaf tabs V1–V11. As best shown in FIG. 6, the leaf tabs designated by the letter A have the live hinges 72 at the lower ends thereof, and the leaf tabs designated by the letter B have live hinges at the upper ends thereof. All vertical rows V1 through V11 have two live hinges adjacent each other followed by two leaf tabs that have two cut ends 68 adjacent each other.

The vertical rows are approximately 2¼ inches spaced in a lateral direction, and the horizontal rows H2 and H4, and H4 and H6 are vertically separated by approximately ½ inch. Identical rows, for example, V3 and V5 in FIG. 6 are horizontally separated by approximately 4½ inches. The leaf tabs themselves are approximately 1½ inches long.

All of the leaf tabs 62 have the same general shape. The vertical rows of leaf tabs are parallel to each other as are the horizontal rows of leaf tabs. The leaf tabs are arranged in rows and are arranged in alternate pairs in each vertical row wherein the live hinges 72 on two adjacent leaf tabs 62 are juxta-positioned with each other with the uncut ends of each pair of leaf tabs being juxta-positioned with the uncut ends of adjacent leaf tabs to form a continuous row of repeated pairs of such leaf tabs.

Each vertical row of leaf tabs is offset with respect to adjacent rows (e.g., rows V4 and V5) whereby the leaf tabs in one row (V4) will be laterally offset from a space between pairs of leaf tabs in the rows adjacent thereto.

It is important to note that the outside and inside layers are joined only at their respective perimeters which reduces the cost of the garment and facilitates its fabrication.

The alternate positions of the live hinges on the leaf tab 62 on the outer layer 14 enable the leaves to assume a random and non-uniform configuration as they project outwardly from the plane of the outer layer 14. See FIG. 8, for example.

The dimensions shown in FIG. 6 show the preferred arrangement of the leaf tabs 62 in the outer layer 14.

From the foregoing, it is seen that this invention provides a very effective inexpensive camouflaged material for outdoor wear accompanied by an inner layer with a tightly woven weave thereto providing apertures no greater than $1/32^{nd}$ of an inch in diameter to effectively prevent the migration of insects therethrough. It is thus seen that this invention will accomplish at least all of its stated objectives.

I claim:

1. A camouflaged material for outdoor wear, comprising, an inside liner material with a fine mesh to prevent the passage of insects therethrough, an outside layer of material, the outside layer being die-cut to have a plurality of leaf tabs cut therein with the leaf tabs having a substantially elliptical shape having a cut perimeter on opposite sides and a cut end therebetween, with an opposite end to the cut end forming a live hinge with respect to the outside layer, to permit the leaf tabs to deflect from the outside layer in a random fashion to create an outer appearance of random leaves, and the outside and inside layers being joined only at their respective perimeters.

2. The material of claim 1 wherein the leaf tabs all have the same general shape.

3. The material of claim 1 wherein the leaf tabs are positioned in parallel spaced rows.

4. The material of claim 1 wherein the leaf tabs are arranged in rows and are arranged in alternate pairs in each row wherein the live hinges on two adjacent leaves are juxta-positioned with each other, and with the uncut ends of each pair of leaf tabs being juxta-positioned with the uncut ends of adjacent leaf tabs to form a continuous row of repeated pairs of such leaf tabs.

5. The material of claim 4 wherein each row of leaf tabs is offset with respect to adjacent rows whereby the leaf tabs in one row will be laterally offset from a space between pairs of leaf tabs in the rows adjacent thereto.

6. The material of claim 1 wherein the outside layer of material is colored in a multi-color random pattern camouflaged series of colors.

7. The material of claim 1 wherein a layer of continuous inside liner material is superimposed over the outside layer and is comprised of a fine mesh to prevent the passage of insects therethrough.

8. The material of claim 7 wherein the fine mesh has openings in the range of $1/32^{nd}$ of an inch in breadth.

9. The material of claim 1 wherein the length of the leaf tabs from the cut end to the insect end is approximately 1½ inches.

10. The material of claim 4 wherein the leaf tabs in each row are longitudinally spaced approximately ½ inch.

11. The method of claim 5 wherein the leaf tabs in each row are longitudinally spaced approximately ½ inch.

12. The method of claim 9 wherein the leaf tabs in each row are longitudinally spaced approximately ½ inch.

13. An outside garment for hunting comprised of an inner layer of fine mesh liner material, and an outside layer superimposed over the liner material, the invention comprising, the outside layer being die-cut to have a plurality of leaf tabs cut therein with the leaf tabs having a substantially elliptical shape having a cut perimeter on opposite sides and a cut end therebetween, with an opposite end to the cut end forming a live hinge with respect to the outside layer, to permit the leaf tabs to deflect from the outside layer in a random fashion to create an outer appearance of random leaves, and wherein the outside layer and inside layer of the garment is comprised of a plurality of sewn seams at the perimeters of a plurality of large portions of the garment, wherein the seams are the only connection between the outside layer and the inner liner.

14. The garment of claim 13 wherein the leaf tabs all have the same general shape.

15. The garment of claim 13 wherein the leaf tabs are positioned in parallel spaced rows.

16. The garment of claim 13 wherein the leaf tabs are arranged in rows and are arranged in alternate pairs in each row wherein the live hinges on two adjacent leaves are juxta-positioned with each other, and with the uncut ends of each pair of leaf tabs being juxta-positioned with the uncut ends of adjacent leaf tabs to form a continuous row of repeated pairs of such leaf tabs.

17. The garment of claim 13 wherein each row of leaf tabs is offset with respect to adjacent rows whereby the leaf tabs in one row will be laterally offset from a space between pairs of leaf tabs in the rows adjacent thereto.

18. The material of claim 13 wherein the outside layer of material is colored in a multi-color random pattern camouflaged series of colors.

19. The method of claim 13 wherein the fine mesh has openings in the range of $1/32^{nd}$ of an inch in breadth.

20. The garment of claim 13 wherein the length of the leaf tabs from the cut end to the end is approximately 1½ inches.

21. The garment of claim 13 wherein the length of the leaf tabs in each row are longitudinally spaced ½ inches.

* * * * *